US011085211B2

(12) United States Patent
Fuchs

(10) Patent No.: US 11,085,211 B2
(45) Date of Patent: Aug. 10, 2021

(54) MOTOR VEHICLE DOOR LOCK

(71) Applicant: Kiekert Aktiengesellschaft, Heiligenhaus (DE)

(72) Inventor: Carsten Fuchs, Dusseldorf (DE)

(73) Assignee: Kiekert AG, Heiligenhaus (DE)

( * ) Notice: Subject to any disclaimer, the term of this patent is extended or adjusted under 35 U.S.C. 154(b) by 294 days.

(21) Appl. No.: 16/379,967

(22) Filed: Apr. 10, 2019

(65) Prior Publication Data

US 2019/0234116 A1 Aug. 1, 2019

Related U.S. Application Data

(62) Division of application No. 14/381,639, filed as application No. PCT/DE2013/000105 on Feb. 26, 2013, now abandoned.

(30) Foreign Application Priority Data

Feb. 28, 2012 (DE) ..... 202012001960.0

(51) Int. Cl.
*E05B 77/40* (2014.01)
*E05B 81/00* (2014.01)
(Continued)

(52) U.S. Cl.
CPC ..... *E05B 81/00* (2013.01); *E05B 77/40* (2013.01); *E05B 81/06* (2013.01); *E05B 81/14* (2013.01); *E05B 81/20* (2013.01); *Y10T 292/57* (2015.04)

(58) Field of Classification Search
CPC ..... E05B 81/00; E05B 77/40; E05B 81/06; E05B 81/14; E05B 81/20; Y10T 292/57
See application file for complete search history.

(56) References Cited

U.S. PATENT DOCUMENTS 5,538,298 A 7/1996 Ikeda
5,582,448 A 12/1996 Inoue
(Continued)

FOREIGN PATENT DOCUMENTS

DE 198 28 040 A1 12/1999
DE 102 16 313 A1 10/2003
(Continued)

OTHER PUBLICATIONS

International Search Report and translation for corresponding patent application No. PCT/DE2013/000105 dated Aug. 21, 2013.

*Primary Examiner* — Kristina R Fulton
*Assistant Examiner* — Thomas L Neubauer
(74) *Attorney, Agent, or Firm* — Renner, Otto, Boisseile & Sklar, LLP

(57) ABSTRACT

A method of forming a motor vehicle door lock includes arranging a lever, providing an electric drive that pivots the lever to place the motor vehicle door lock in an open state and includes a motor and a wheel gear that is driven by the motor and has a circumferential face, forming at least one damping stop on the wheel gear that protrudes axially from the circumferential face of the wheel gear and extends from the circumferential face toward a stop plane that is spaced from and parallel to an actuating plane in which the wheel gear and the lever are rotatable, providing a housing stop surface that is engageable by the damping stop along the stop plane in a rotational direction of the wheel gear, and forming the damping stop and the wheel gear as a single piece using a two-component injection molding process.

18 Claims, 2 Drawing Sheets

(51) Int. Cl.

| | |
|---|---|
| ***E05B 81/06*** | (2014.01) |
| *E05B 81/14* | (2014.01) |
| *E05B 81/20* | (2014.01) |

(56) References Cited

U.S. PATENT DOCUMENTS

| | | | | |
|---|---|---|---|---|
| 5,615,564 | A | 4/1997 | Inoue | |
| 5,632,515 | A | 5/1997 | Dowling | |
| 5,642,636 | A | 7/1997 | Mitsui | |
| 2004/0046399 | A1* | 3/2004 | Shafry | E05B 77/38 292/216 |
| 2005/0134054 | A1* | 6/2005 | Stefanic | E05B 17/0004 292/201 |
| 2007/0111845 | A1 | 5/2007 | Hayakawa | |
| 2010/0253095 | A1* | 10/2010 | Bendel | E05B 81/14 292/200 |
| 2011/0241360 | A1 | 10/2011 | Kitamura | |
| 2012/0242095 | A1* | 9/2012 | Niwa et al. | E05B 85/02 292/142 |
| 2012/2424209 | | 9/2012 | Niwa | |

FOREIGN PATENT DOCUMENTS

| | | | | |
|---|---|---|---|---|
| EP | 1 225 290 | A2 | 7/2002 | |
| FR | 2775717 | | 9/1999 | |
| JP | H035871 | U | 6/1991 | |
| JP | H06-346645 | | 12/1994 | |
| JP | 2284232 | | 5/1995 | |
| JP | 2007/138532 | | 6/2007 | |
| JP | 4737796 | | 5/2011 | |
| JP | 2011/125535 | | 10/2011 | |
| JP | WO2011125535 | * | 10/2011 | E05B 77/42 |
| WO | 2010/129303 | A2 | 11/2010 | |

* cited by examiner

MOTOR VEHICLE DOOR LOCK

RELATED APPLICATIONS

This application is a divisional application of U.S. application Ser. No. 14/381,639 filed on Aug. 28, 2014 which is a national phase of International Application No. PCT/DE2013/000105 filed Feb. 26, 2013, and claims priority to German Application No. 202012001960.0 filed Feb. 28, 2012, which are hereby incorporated by reference in their entirety.

FIELD OF THE INVENTION

The invention relates to a motor vehicle door lock, comprising a locking mechanism and an electric drive for the locking mechanism and at least one stop for the electric drive.

BACKGROUND OF THE INVENTION

Such a motor vehicle door lock is, for instance, disclosed in DE 198 28 040 B4, in which two stop elements are provided for an electric drive. In the known teaching, the electric drive serves to open or close the respective locking mechanism, with the stop elements being arranged on one hand on the rotary latch and, on the other hand, on the pawl. This has generally proven to be successful.

Prior art embodiments may, however, experience noise problems in particular due to the generated forces. Such electric drives are frequently used, in particular where the locking mechanism is to be electrically opened or closed. Any of the described processes actually correspond to the electric drive moving with more or less impact against one or several stops. This operation produces even more noise if the stop is, for instance, located in a metal lock case and the electric drive, moving against the stop generates a respective noise, which is transferred as a structure-borne noise to the car body and may even be amplified. The invention aims to remedy this situation.

SUMMARY OF THE INVENTION

The invention is based on the technical problem of developing said motor vehicle door lock further in a way that the generated forces are absorbed in such a way that the overall noise level is reduced whilst at the same time simplifying the design.

In order to solve this technical problem, the invention suggests for the stop to be designed as a damping stop arranged on the electric drive.

Generally, the damping stop arranged on the electric drive cooperates with at least one housing stop. An acoustically particularly advantageous force absorption and also an easy to assemble and to produce design is provided by a plastic housing stop. The housing stop can actually be produced in one process together with the plastic housing, although this is not mandatory. Alternatively, the housing stop can also be formed on the lock case (made of metal).

In any case, the stop on the electric drive, designed as a damping stop in the invention, ensures that movements of the electric drive are effectively and resiliently decelerated in the area of the damping stop. This is achieved as the damping stop has an overall elastic design and ensures that the electric drive containing the damping stop cooperates in its end position or generally in a specified position with low noise or with practically no noise with the at least one housing stop, as the force or energy is absorbed by the housing stop.

For this purpose, the damping stop is typically arranged on a driven wheel gear as part of the electric drive. The electric drive actually generally comprises an electric motor with a worm gear and a driven wheel gear meshing with the worm gear. Any actuating movements of the electric drive thus correspond with the rotations of the driven wheel gear around its axis of rotation. During these rotations, the driven wheel gear moves along a certain route with at least one damping stop arranged thereon against the said housing stop.

The damping stop is typically connected to the driven wheel gear. In general, the damping stop and the driven wheel gear can be designed as a single piece. The entire driven wheel gear can actually, like the damping stop, be made of plastic. Different types of plastic can also be used. In this case, the driven wheel gear and the damping stop are produced together in a so-called two-component injection molding process. In this case, the damping stop is typically formed on the driven wheel gear.

It has proven to be advantageous for the damping stop to be arranged radially in relation to a rotary axis of the driven wheel gear. It is also recommended to position the damping stop on the external circumference of the driven wheel gear. As a result, the damping stop can, on one hand, move with its full surface against the housing stop and is also arranged at an exposed position of the driven wheel gear, e.g. on its external circumference. The damping stop can therefore not collide with other lever or elements inside the lock housing. The generated forces are absorbed in the best possible manner by a large lever arm in order to optimize the loads on the working areas and improve the acoustic characteristics.

This is also aided by the fact that the damping stop advantageously projects axially from the actuating plane defined by the driven wheel gear. This means that the driven wheel gear determines said actuating plane in the first instance by its arrangement and movement inside the lock housing. In relation to this actuating plane in which, for instance levers impinged upon by the driven wheel gear are arranged or into which they can project, the damping stop is positioned on or extends from this actuating plane in axial direction. As a result, the damping stop is so to speak, arranged raised up from the actuating plane and can thus not interact with levers lying or extending into the actuating plane or arranged on other lock elements, which is desirable in order to prevent collisions.

As a result, a motor vehicle door lock is provided that is characterized by a particularly good force absorption and low-noise operation and that has a simple, cost-effective and compact design. For this purpose, the electric drive for opening and/or closing of the locking mechanism contains at least an integrated damping stop. In most cases, two damping stops are provided, forming an obtuse angle therebetween of, for instance, 100°. As a result, both an end stop and a starting stop can be realized and defined for the electric drive. It is self-evident that the damping stop arranged on the electric drive cooperates in this case with a respective housing stop.

Alternatively, also two end stops can be provided when using a centre/zero spring. In this arrangement, the base position is positioned and damped without stop.

BRIEF DESCRIPTION OF THE DRAWINGS

Below, the invention is explained in detail with reference to a drawing showing only one embodiment, in which.

DETAILED DESCRIPTION OF THE INVENTION

Figure 1:
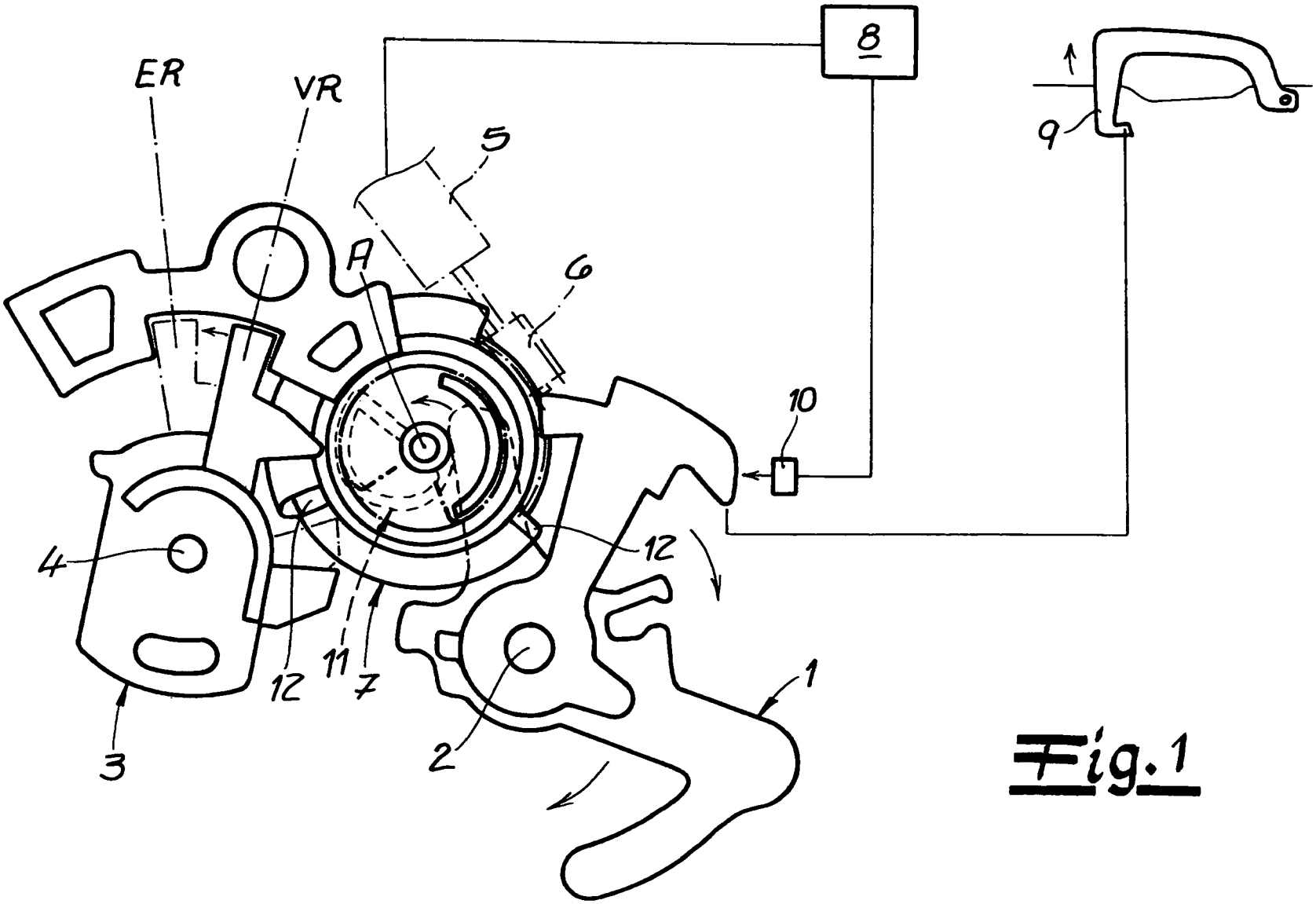
FIG. 1 shows a motor vehicle door lock of the invention with the main elements of the invention and FIG. 2 shows details of the electric drive or the driven wheel gear provided at this point.

The figures show a motor vehicle door lock with a triggering lever 1 impinging upon a locking mechanism. The triggering lever 1 is pivotable around axis 2 and mounted in a central locking housing—not shown. Pivoting movements of the triggering lever 1 in clockwise direction—indicated by an arrow—correspond to the pawl of the locking mechanism being lifted off the rotary latch. As a result, the rotary latch is opened with the assistance of a spring.

This described opening process is electrically initiated in the example with the aid of an electric drive 5, 6, 7. In addition to this electric drive 5, 6, 7, the motor vehicle door lock generally also contains a locking lever 3, pivotally mounted around an axis of rotation 4. The pivoting movements of the locking lever 3 and those of the triggering lever 1 are both initiated with the aid of the electric drive 5. 6, 7.

In the embodiment, the electric drive 5, 6, 7 comprises an electric motor 5, a worm gear 6 driven by the electric motor 5 and a driven wheel gear 7 driven with or by the worm gear. A control unit 8 is provided for actuating the electric motor 5. The control unit 8 is impinged on after actuation of a handle 9 by an operator wishing to open the door. For this purpose, the handle 9 contains a signal generator 10.

The signal generator 10 transmits the opening wish of the operator onto the control unit 8 which in turn actuates the electric drive 5, 6, 7. In the embodiment shown in FIG. 1 this results in a counter-clockwise movement of the driven wheel gear 7.

As the driven wheel gear 7 contains an opening contour or an opening cam 11, said counter-clockwise movement of the driven wheel gear 7 causes the opening contour or the opening cam 11 to act upon the triggering lever 1 during electric opening and to pivot said lever around its axis or axis of rotation 2 in clockwise direction. At the end of this process, the pawl is lifted off the rotary latch which then opens with the assistance of a spring. The locking mechanism is now open.

In order to restrict the driven wheel gear 7 or to stop the electric drive 5, 6, 7 at the end of the described electric opening process, a stop 12 is provided on the driven wheel gear 7 in the embodiment which is designed as a damping stop 12 in this case. The damping stop 12 cooperates with a housing stop 13—only indicated. The housing stop 13 can be arranged on a housing lid—not explicitly shown—or can be molded into the housing lid to form a single piece (see FIG. 2).

In the embodiment, the driven wheel gear 7 contains two damping stops 12. As apparent from FIG. 2, the two damping stops 12 form an obtuse angle □ in relation to the axis of rotation A of the driven wheel gear 7, which can be or is approximately 100° to 120° in the embodiment, although the invention is not limited to this.

Figure 2:
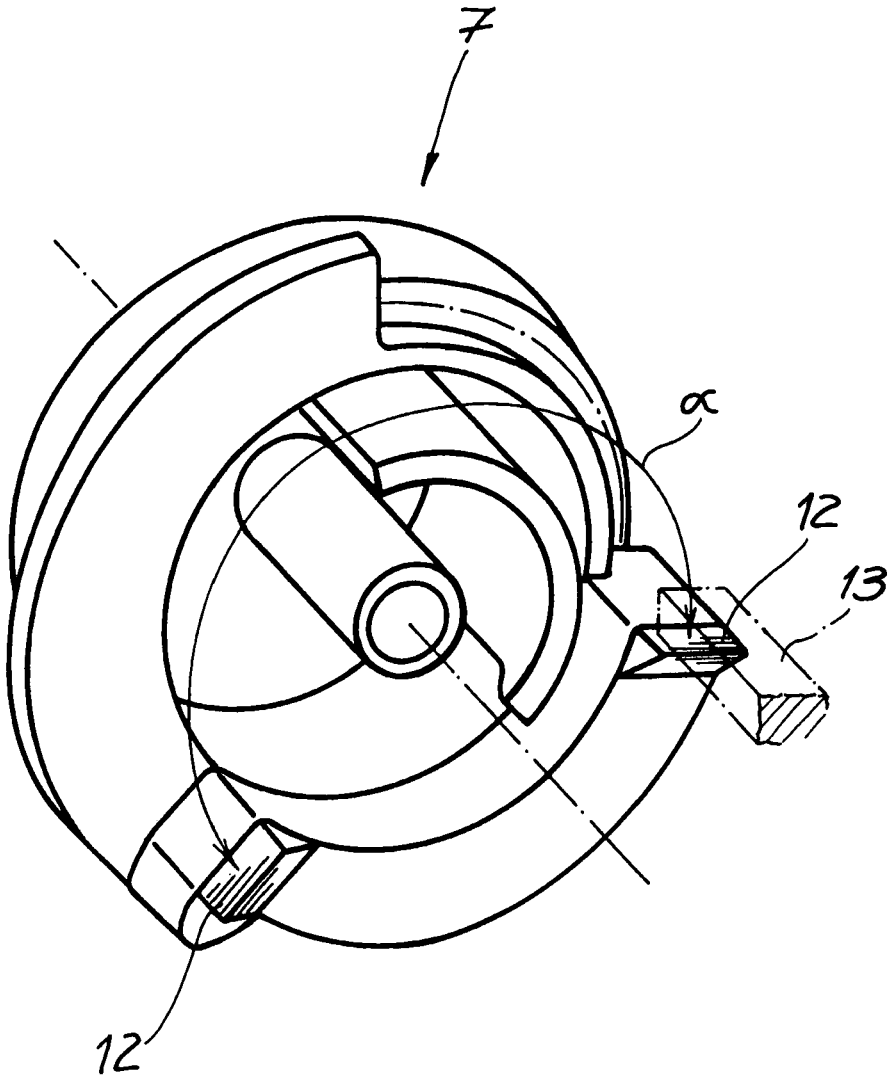

The right damping stop 12 in FIG. 2 serves to gently decelerate the opening movements of the electric drive 5, 6, 7 at its end. In contrast, the left damping stop 12 in FIG. 2 acts as a stop or end stop for a counter movement of the drive 5, 6, 7, which may be part of an emergency operation in the embodiment. The electric opening described in detail above corresponds, on the other hand, to a normal operation.

During emergency operation, the driven wheel gear 7 thus carries out a clockwise movement around the axis of rotation A. During this process, the locking lever 3 located in its "locked" (VR) position in FIG. 1 is moved into its "unlocked (ER)" position by the driven wheel gear 7. As a result, the locking mechanism can be directly mechanically opened during emergency operation, as the locking lever 3 now assumes its "unlocked" position, thus producing a mechanical connection from the handle 9 to the triggering lever 1. This functionality is, however, of minor importance for further examination.

The decisive fact for the present invention is that at the end of its movement representing the emergency operation, the driven wheel gear 7 moves with a second damping stop 12 against an additional housing stop 13. The same also applies for the normal operation in which the first damping stop 12 moves against the respective housing stop 13. In both cases this is a gentle movement or movement being affected by the resilient effect of the respective damping stop 12, so that no or hardly any noise associated with the movement of the electric drive 5, 6, 7 is generated. In order to achieve this in detail, FIG. 2 shows that the respective damping stop 12 is connected to the driven wheel gear 7. The damping stop 12 and the driven wheel gear 7 are typically designed as a single piece. Both the damping stop 12 and the driven wheel gear 7 are generally made of plastic.

The driven wheel gear 7 and the damping stops 12 can be made of plastic such as PE (Polyethylene), PP (Polypropylene) and, in particular, PA (Polyamide). In contrast, the housing stop 13 is predominantly made of elastomeric plastic, such as EPDM (ethylene propylene rubber), NR (natural rubber), SBR (styrene butadiene rubber) or NBR (acrylonitrile butadiene rubber).

In a further embodiment, the damping stop 12 and the driven wheel gear 7 can be produced in a common manufacturing process. This manufacturing process is typically a two-component injection molding process as a different type of plastic is used for the damping stop 12 and for the driven wheel gear 7.

If the damping stop 12 is made from an elastomeric plastic, the housing stop can also be made from a plastic.

It is also apparent from FIG. 2 that the respective damping stop 12 is arranged radially in relation to the axis of rotation A of the driven wheel gear 7. The overall result is that the damping stop 12 moves with its full surface or nearly with its full surface against the associated housing stop 13 during the described radial movement of the driven wheel gear during normal or emergency operation. This means that the cooperation between the damping stop 12 and the housing stop 13 takes place with the greatest amount of the damping stop 12 and housing stop surfaces 13 resting against each other. This allows optimum use of the elastomeric or resilient effect of the damping stop 12 for absorbing any forces and effectively dampening any noise.

It has also proven to be advantageous for the damping stop 12 to be arranged along the external circumference of the driven wheel gear 7. In the embodiment, the damping stop 12 is axially positioned on an actuating plane defined by the driven wheel gear 7.

This actuating plane is best apparent when comparing FIGS. 1 and 2. Both the locking lever 3 and the triggering lever 1 are arranged on the actuating plane. The damping stop 12 protrudes axially in relation to said elements 1, 3 or the actuating plane described by the driven wheel gear 7. This ensures that the damping stop 12 cannot cooperate with elements of the motor vehicle door lock arranged on or protruding into the actuating plane. Instead it is ensured that the damping stop 12 only cooperates with the housing stop 13, extending into the stop plane arranged above the actuating plane just like the damping stop 12. This damping plane is arranged above the plane of projection in FIG. 1 and only serves to ensure the cooperation between the damping stop 12 and the housing stop 13, as described.

The invention claimed is:

1. A method of forming a motor vehicle door lock, the method comprising:

arranging a lever;

providing an electric drive that pivots the lever to place the motor vehicle door lock in an open state, wherein the electric drive includes a motor and a wheel gear that is driven by the motor and has a circumferential face;

forming at least one stop for the electric drive, wherein the at least one stop comprises at least one damping stop arranged on the wheel gear, the at least one damping stop protruding axially from the circumferential face of the wheel gear and extending from the circumferential face toward a stop plane that is spaced from and parallel to an actuating plane in which the wheel gear and the lever are rotatable;

providing at least one corresponding housing stop surface, wherein the at least one damping stop engages the at least one corresponding housing stop surface along the stop plane in a rotational direction of the wheel gear; and forming the at least one damping stop and the wheel gear as a single piece using a two-component injection molding process.

2. The method according to claim 1 further comprising arranging the at least one damping stop radially in relation to an axis of rotation of the wheel gear.

3. The method according to claim 1 further comprising forming the at least one damping stop to extend axially upward from the circumferential face of the wheel gear.

4. The method according to claim 1 further comprising forming the at least one damping stop to have an engaging surface that is engageable with the at least one housing stop surface and an entire surface area of the engaging surface is engageable against the at least one housing stop surface.

5. The method according to claim 1 further comprising forming the at least one damping stop and the wheel gear of a plastic material.

6. The method according to claim 5 further comprising forming the at least one damping stop of a first plastic material and forming the wheel gear of a second plastic material that is different than the first plastic material.

7. The method according to claim 5 further comprising forming the at least one damping stop and the wheel gear of polyethylene, polypropylene, or polyamide.

8. The method according to claim 1 further comprising forming the at least one damping stop to include a first damping stop and a second damping stop, and the at least one housing stop surface to include a first housing stop surface and a second housing stop surface, the first damping stop being engageable against the first housing stop surface and the second damping stop being engageable against the second housing stop surface.

9. The method according to claim 8 further comprising forming the first damping stop and the second damping stop to form an obtuse angle in relation to an axis of rotation of the wheel gear.

10. The method according to claim 1 further comprising arranging the actuating plane as a common actuating plane in which both the wheel gear and the lever are rotatable.

11. The method according to claim 10 further comprising arranging the at least one damping stop and the at least one corresponding housing stop surface to engage each other outside of the common actuating plane.

12. The method according to claim 1 further comprising forming the at least one housing stop surface on a housing.

13. The method according to claim 12 further comprising forming the housing to include a housing lid and/or a lock case and arranging the at least one housing stop surface on the housing lid and/or the lock case.

14. The method according to claim 13 further comprising forming the at least one housing stop surface as a single piece with the housing lid and/or the lock case.

15. The method according to claim 14 further comprising forming the at least one housing stop surface of an elastomeric plastic material.

16. The method according to claim 12 further comprising forming the at least one housing stop surface of a plastic material.

17. The method according to claim 16 further comprising:

forming the housing of a plastic material; and forming the at least one housing stop surface and the housing together in a single manufacturing process.

18. The method according to claim 17 further comprising forming the at least one housing stop surface of ethylene propylene rubber, natural rubber, styrene butadiene rubber, or acrylonitrile butadiene rubber.

* * * * *